US008602413B2

(12) United States Patent
St. Ours et al.

(10) Patent No.: US 8,602,413 B2
(45) **Date of Patent: *Dec. 10, 2013**

(54) APPARATUS FOR ELECTRONICALLY DIVERTING SIGNATURES

(75) Inventors: Joseph Adrian St. Ours, Lee, NH (US); Mark Anthony Wingate, New Durham, NH (US); David Elliot Whitten, Barrington, NH (US); Jared David Kinson, Georgetown, ME (US)

(73) Assignee: Goss International Americas, Inc., Durham, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/477,358

(22) Filed: May 22, 2012

(65) Prior Publication Data

US 2012/0228824 A1 Sep. 13, 2012

Related U.S. Application Data

(62) Division of application No. 12/590,358, filed on Nov. 6, 2009, now Pat. No. 8,196,926.

(51) Int. Cl.
*B65H 39/10* (2006.01)

(52) U.S. Cl.
USPC ..... 271/303; 271/301; 271/302

(58) Field of Classification Search
USPC ..... 270/52.04; 271/225, 264, 298, 301–304
See application file for complete search history.

(56) References Cited

U.S. PATENT DOCUMENTS

| | | | | |
|---|---|---|---|---|
| 3,342,410 | A | 9/1967 | Masterson et al. | |
| 4,397,455 | A | 8/1983 | Hickey | |
| 4,424,965 | A | 1/1984 | Faltin | |
| 4,573,813 | A | 3/1986 | Aoki et al. | |
| 4,871,163 | A | 10/1989 | Landa et al. | |
| 5,083,769 | A * | 1/1992 | Young, Jr. | 271/280 |
| 5,217,220 | A | 6/1993 | Carlson et al. | |
| 5,984,304 | A | 11/1999 | Wacker | |
| 6,186,501 | B1 | 2/2001 | St. Ours | |
| 6,547,241 | B2 * | 4/2003 | Yoshida et al. | 271/303 |
| 6,572,097 | B2 | 6/2003 | d'Agrella et al. | |
| 6,572,098 | B2 | 6/2003 | Schaefer et al. | |
| 6,612,213 | B1 | 9/2003 | Bredenberg et al. | |
| 6,764,236 | B2 * | 7/2004 | Suzuki | 400/642 |
| 7,044,902 | B2 * | 5/2006 | d'Agrella et al. | 493/224 |
| 7,051,928 | B2 | 5/2006 | Kallin | |
| 7,384,039 | B2 | 6/2008 | Cote et al. | |
| 2008/0001350 | A1 * | 1/2008 | Okamoto et al. | 271/303 |
| 2009/0127763 | A1 | 5/2009 | Cossette | |
| 2009/0243199 | A1 | 10/2009 | Daigo et al. | |

FOREIGN PATENT DOCUMENTS

| | | | | |
|---|---|---|---|---|
| EP | 564291 | A2 * | 10/1993 | B41J 13/00 |
| GB | 2073153 | A * | 10/1981 | B65H 9/00 |
| JP | 62157170 | A * | 7/1987 | B65H 29/60 |
| JP | 63134464 | A * | 6/1988 | B65H 29/70 |
| JP | 04251065 | A * | 9/1992 | B65H 29/60 |
| JP | 06156850 | A * | 6/1994 | B65H 29/60 |

* cited by examiner

*Primary Examiner* — Prasad Gokhale
(74) *Attorney, Agent, or Firm* — Davidson, Davidson & Kappel, LLC

(57) ABSTRACT

An apparatus for diverting incoming printed products is provided. The apparatus includes a roll, a first motor coupled to the roll and a controller coupled to the first motor for controlling the rotation of the roller for diverting printed products along one of two different paths, each path associated with a direction of rotation of the roll. This apparatus may also include a shaft with at least one flipper mounted thereon and a second motor coupled to the shaft.

7 Claims, 7 Drawing Sheets

APPARATUS FOR ELECTRONICALLY DIVERTING SIGNATURES

CROSS REFERENCE TO RELATED APPLICATIONS

This is a divisional of U.S. application Ser. No. 12/590,358 filed on Nov. 6, 2009, the entire disclosure of which is hereby incorporated by reference herein.

The present invention relates generally to printing presses and more particularly to an apparatus for electronically diverting signatures.

BACKGROUND

Commercially available web fed rotary printing presses typically include printing units arranged at fixed locations in the pressroom. After the web has moved through the printing units, it is transported to folder and cutter units that fold the web and cut the web lengthwise and crosswise into printed products, such as signatures used to create newspapers, magazines, and the like. The web is cut into signatures that are typically conveyed to a fan or other delivery system, which deposits them on, for example, a conveyor belt. The printing press can be configured so that signatures are evenly diverted among several fans or other delivery systems using a diverter mechanism, including mechanical cam-driven flipper diverters or mechanical eccentric lobe diverters.

A conventional mechanical cam-type diverter 10 is illustrated in FIG. 1 having a shaft 15 and a plurality of diverters 20 mounted thereon. Such diverters typically require torsion springs to pre-load a cam follower 25 against a surface 30 of a rotating cam 40 and maintain surface contact through the action of cam 40. The torsion bar 35 preload must be set high enough so that cam follower 25 does not lift off the cam surface 30 at the maximum operating speed requirement of the diverter 10. Since the torsion bar 35 preload adjustment is a manual setting, the preload is always present in the torsion bar 35, even when the diverter 10 is not operating. Since the high preload is always present, the cam follower 25 and cam surface 30 are always subjected to high preload stresses that can prematurely wear the cam surface 30 and reduce the life of cam follower 25. This high preload force also requires the mechanical assembly supporting the diverter shaft 15 and torsion bar 35 to be sufficiently strong and stiff to prevent vibration and/or deformation under normal operation. Another limitation of this design is that the cam action angles are fixed and therefore cannot be adjusted to take advantage of smaller product lengths and the increased spaces between them. Furthermore, the number of cam actions controlling the diverter shaft 15 is fixed at the time of design and is therefore impossible to vary once the cam 40 is manufactured. So if the cam 40 has one rise action and one fall action, the diverter shaft 15 will be limited to this particular characteristic for the life of the cam and such characteristics may only be changed by changing the cam. Finally, since the cam 40 forces the diverter shaft 15 to oscillate through a relatively small angle of rotation, there is a risk of premature bearing failure of the bearings for diverter shaft 15 due to uneven stresses on the bearings.

BRIEF SUMMARY OF THE INVENTION

An object of the present invention is to eliminate the problems with the mechanical cam-type diverter 10. An additional object is to provide a diverter system having a simpler mechanism resulting in a significant cost savings in both part count and assembly time.

The present invention provides an apparatus for diverting incoming printed products. The apparatus includes a shaft, at least one first flipper mounted in a first fixed direction on the shaft, a motor coupled to the shaft, preferably a servo motor, and a controller coupled to the motor for controlling positioning of the shaft to allowing printed products to be diverted along different paths, each path associated with a particular position of the shaft. The apparatus may further include a coupler interconnected between the motor and the shaft, preferably a low inertia coupler. The controller is preferably configured to move the shaft according to a predetermined electronic cam profile and to move the shaft in a single direction according to the predetermined cam profile. Preferably, the predetermined electronic cam profile is set to divert the incoming printed products into two output product streams, and in one embodiment the predetermined electronic cam profile is set to divert one of every three products into a separate one of the two output product streams.

The apparatus of the present invention may further include at least one input sensor for detecting edges of the incoming printed products, the at least one input sensor coupled to the controller, and the controller may be programmed to move the shaft in one of a plurality of predetermined electronic cam profiles selected based upon an input from the at least one input sensor. The apparatus may still further include at least one output sensor for detecting edges of diverted printed products, the at least one output sensor coupled to the controller, and the controller may be programmed to move the shaft to a fixed position based on an input from the at least one output sensor indicating a product jam so that the fixed position of the shaft causes the printed products to be diverted to a dedicated output stream for collecting printed products in the event of a jam. The apparatus may still further include at least one second flipper mounted in a second fixed direction on the shaft, the second direction different from the first direction.

The present invention also provides an apparatus for diverting incoming printed products including a roll having an axis, a first motor coupled to the roll and a controller coupled to the motor for controlling the rotation of the roller for diverting printed products along one of two different paths, each path associated with a direction of rotation of the roll. The apparatus of this embodiment may also include a shaft having an axis coincident with axis of the roll, at least one flipper mounted in a fixed direction on the shaft, a second motor coupled to the shaft, and the controller may also coupled to the second motor for controlling positioning of the at least one flipper mounted on the shaft to assist in diverting the printed along one the two different paths.

BRIEF DESCRIPTION OF THE DRAWINGS

The following detailed description, given by way of example and not intended to limit the present invention solely thereto, will best be understood in conjunction with the accompanying drawings in which.

DETAILED DESCRIPTION OF A PREFERRED EMBODIMENT

Figure 1:
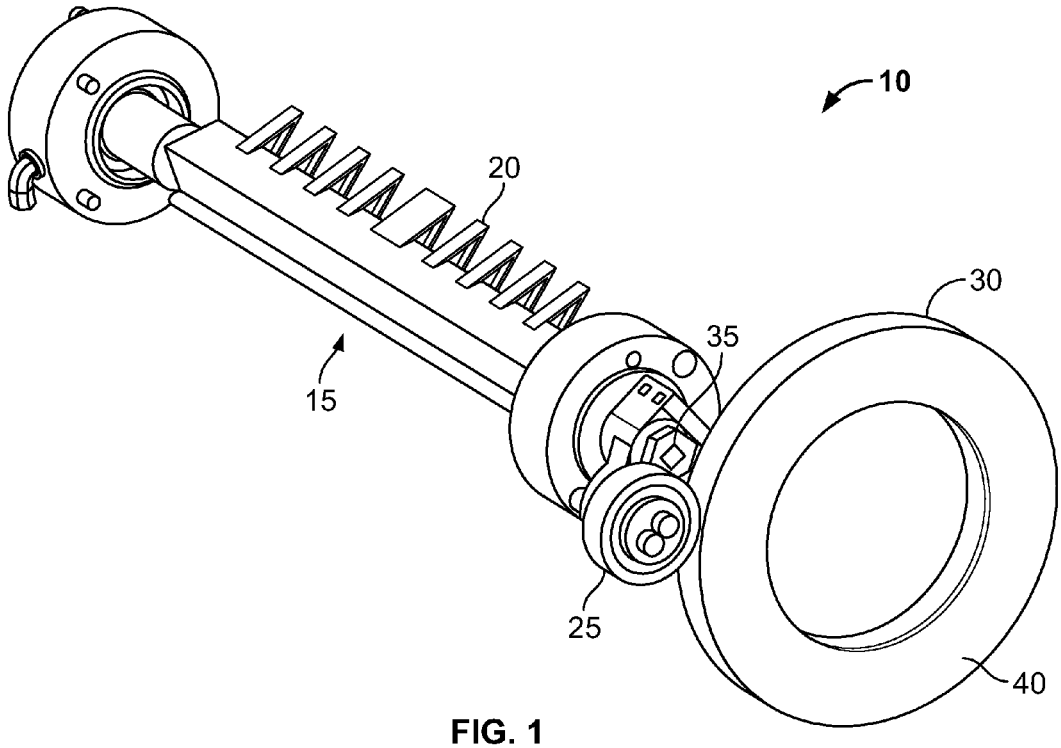
FIG. 1 (Prior Art)
FIG. 1 illustrates a known conventional diverter.
Figure 2:
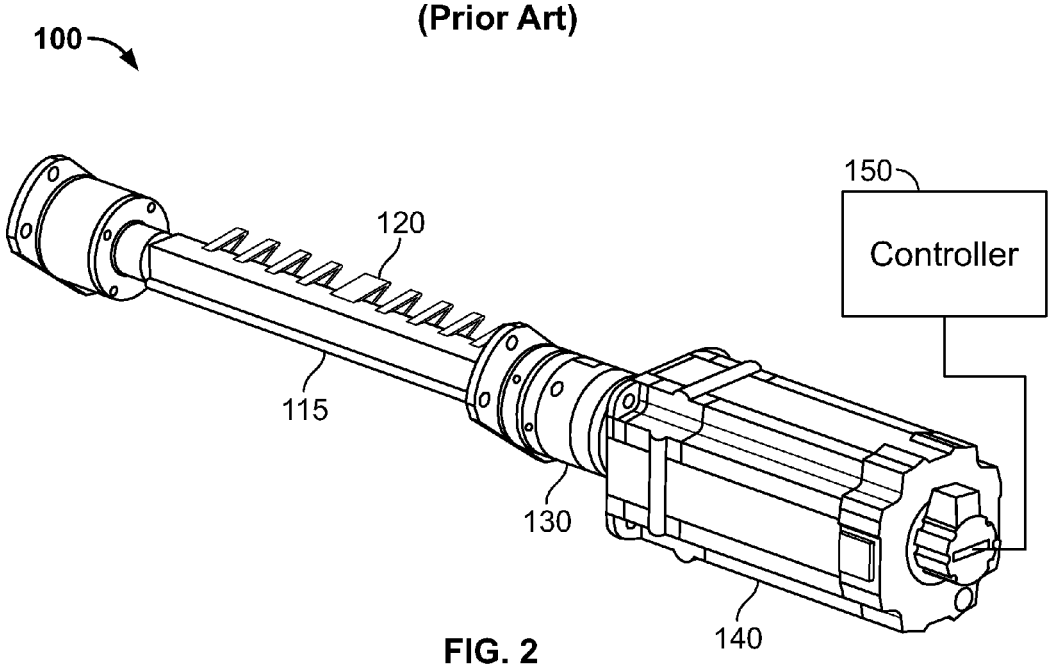
FIG. 2 shows a diverter according to an embodiment of the present invention.

FIG. 2 shows a diverter 100 according to an embodiment of the invention having a diverter shaft 115 with diverter flippers 120 mounted thereon, in a similar manner to the conventional diverter 10 of FIG. 1. However, diverter shaft 115 is driven by a low inertia drive motor, for example, servo motor 140 under the control of a controller 150 instead of the mechanical cam and follower system of the conventional system 10. Servo motor 140 is coupled to the diverter shaft 115 via a low inertia coupler 130.

Controller 150 is programmed with a preset cam table which is used to drive servo motor 140 in a manner which accurately follows the motion which would be caused by a selected cam in the conventional diverter system of FIG. 1. Since diverter shaft 115 is connected to a shaft of motor 140 through a torsionally rigid low inertia coupler 130, diverter shaft 115 is also forced to accurately follow the movement commanded by controller 150. In this manner, the present invention allows a programmer to load virtually any desired cam profile (i.e., desired movement profile for diverter shaft 115) into controller 150, without any hardware change necessary, in contrast to the conventional system of FIG. 1 in which the cam 40 would have to be replaced in order to change the cam profile characteristic.

Figure 3:
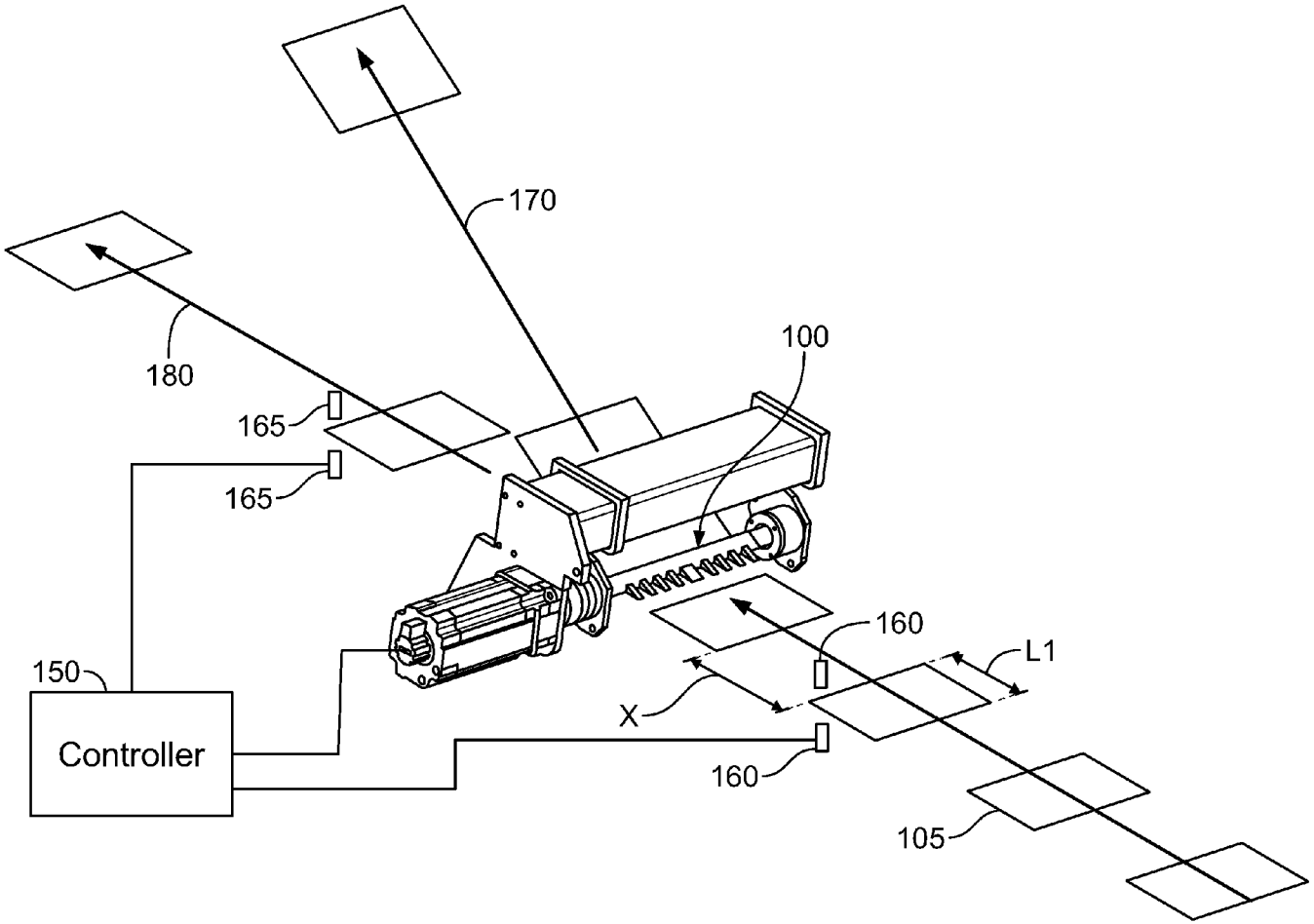
FIGS. 3 to 6 illustrate the operation of embodiments of the diverter of the present invention.
Figure 4:
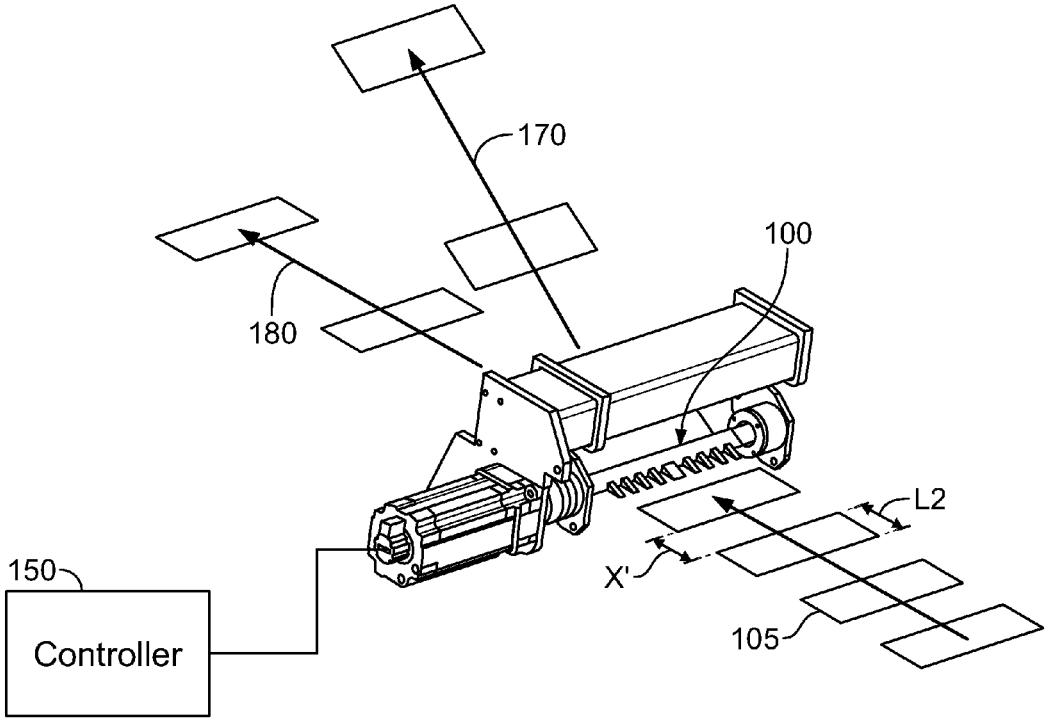

FIGS. 3 and 4 show how the diverter of the present invention can more efficiently use space between products for different product types and cut-off lengths being produced by the same folding machine, by automating the diverter to product timing using edge sensors 160 (not shown in FIG. 4). When edge sensors 160 detect a leading edge of a product passing by, a signal is provided to a controller 150 that synchronizes the diverter shaft 115 and electronic cam with the entering products. In this manner, the need for operator interaction is eliminated, as is the potential for improper setup. In particular, in FIG. 3, the incoming products 105 have a length L1 and a spacing between products 105 of X. Controller 150, by monitoring sensors 160, calculates the length L1 and the spacing X and selects the appropriate electronic cam setting for the incoming product stream among a plurality of preprogrammed electronic cam settings. In FIG. 4, the incoming products 105 have a different length L2 and spacing X', and controller 150 calculates L2 and X' and selects a different electronic cam setting for the incoming product stream of FIG. 4 having different characteristics than the incoming product stream of FIG. 3 based on the calculation of L2 and X'.

In a further embodiment of FIG. 3, edge sensors 165 may be provided after diverter 100, allowing the controller 150 to be alerted when a predetermined number of products are missing (i.e., have not passed by one of the sensors 165), indicating an impending or already-occurred product jam. Controller 150 can then fix the diverter in a position that will only allow products to flow to one of the two streams 170, 180. In a yet further embodiment, controller 150 may alter the diverter shaft 115 to force products to flow to a separate stream 195 as shown in FIG. 6 discussed below, e.g., a stream used for evacuating products from the folder in the event of some type of error, thereby significantly reducing the risk of damage to the diverter shaft and the remainder of the folder due to a jam.

Figure 5:
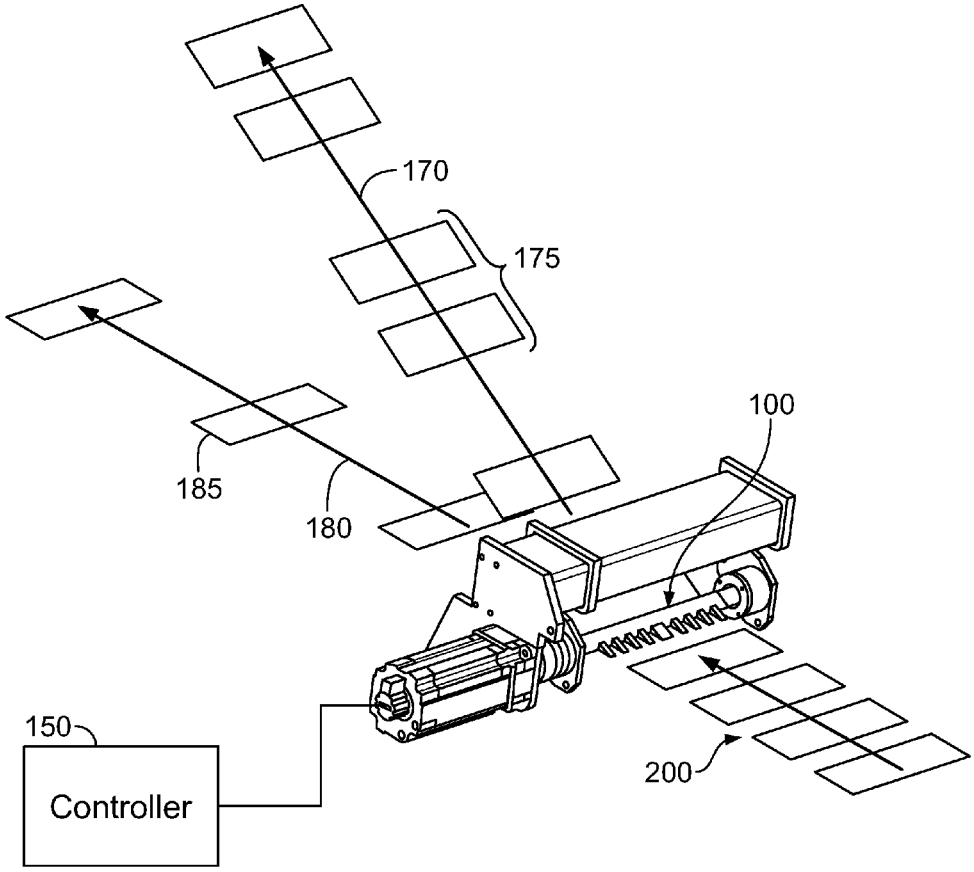

According to the present invention, controller 150 may also be configured to control diverter 100 so that different multiples of product combinations are directed to one product stream with respect to the other. For example, as shown in FIG. 5, an incoming product stream 200 may be diverted such that two products 175 are forced to follow upper stream 170 while only one product 185 is forced to follow lower stream 180.

Figure 6:
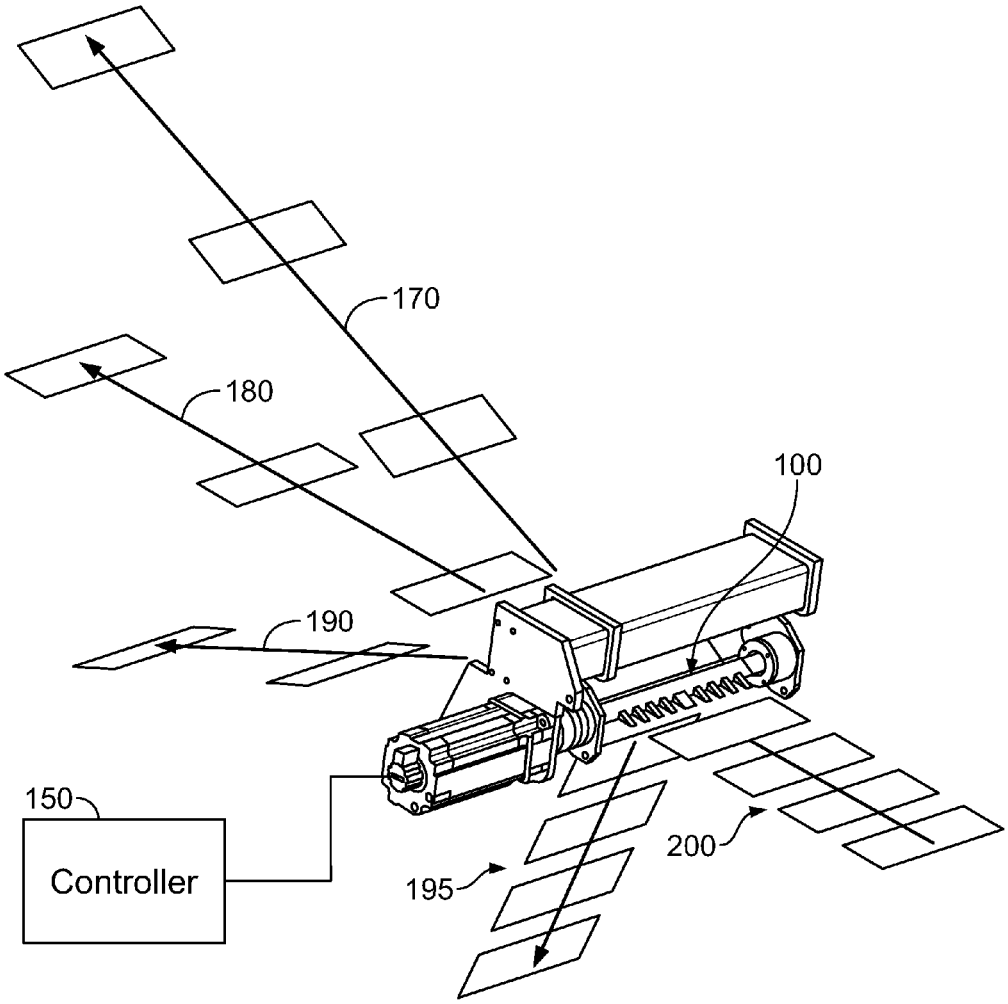

In addition, as shown in FIG. 6, controller 150 may also be configured to control diverter 100 to stop in any combination of different positions, e.g., the three separate product streams 170, 180 and 190, selectively diverting the incoming product stream 200 to the output streams 170, 180, 190. In FIG. 6, diverter 100 is also shown having a fourth output stream 195 for use in temporarily diverting products during a make-ready or when a jam is detected, by blocking and directing the incoming products 200 to output stream 195 and away from the usual product streams 170, 180, 190.

As one of ordinary skill in the art will readily recognize, one feature of the present invention is that controller 150 may be configured to keep diverter shaft 115 stationary (silenced) so that the incoming products 200 only pass through one selected product stream.

Figure 7A:
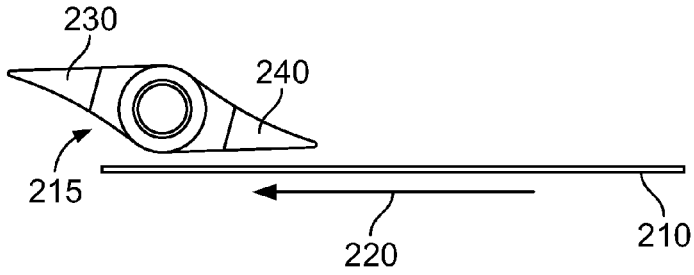
FIGS. 7A and 7B provide detailed views of an alternative embodiment of the present invention.
Figure 7B:
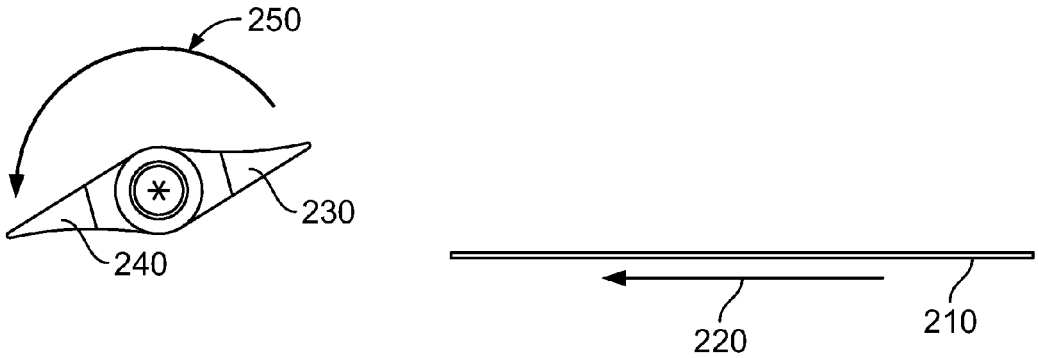

As one of ordinary skill in the art will also readily recognize, the oscillating flipper type diverter shaft 115 shown in FIG. 2, for example, is merely exemplary and many different types of diverter shaft designs may be adapted for use in the present invention. For example, in the further embodiment shown in FIGS. 7A and 7B, a single diverter shaft 215 has two flippers 230, 240 arranged around an axis of the diverter shaft 215 to direct a product 210 passing in a direction 220. In this embodiment, the controller could set the servo motor coupled to shaft 215 to index to the two flippers 230, 240 in a manner that would always have the motor rotating the diverter shaft 215 intermittently in the same direction, e.g., counterclockwise as shown by arrow 250, thereby increasing the life of bearings supporting diverter shaft 215 and of bearings supporting the rotor for the motor driving diverter shaft 215 by ensuring that the bearings wear more uniformly due to the complete revolutions of diverter shaft 215 upon each movement and also helping to distribute bearing lubrication. In addition, the life of the flippers 230, 240 due to wear from contact with product 210 would also be increased given the multiple alternating surfaces acting on the products.

Figure 9A:
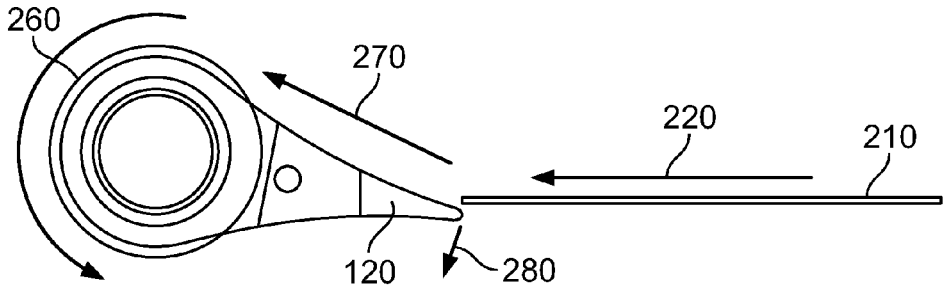
FIGS. 8, 9A and 9B provide detailed views of another alternative embodiment of the present invention.
Figure 9B:
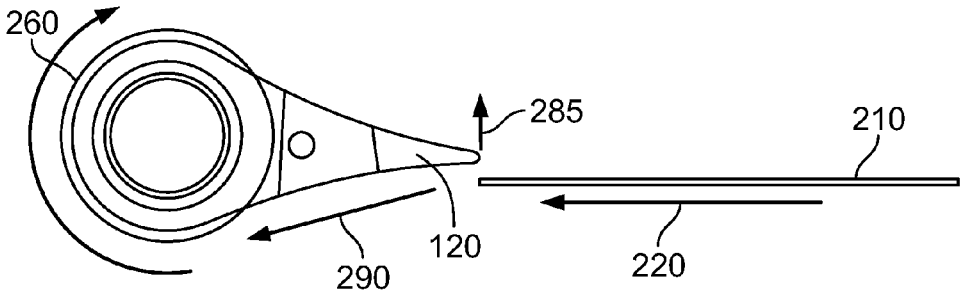
Figure 8:
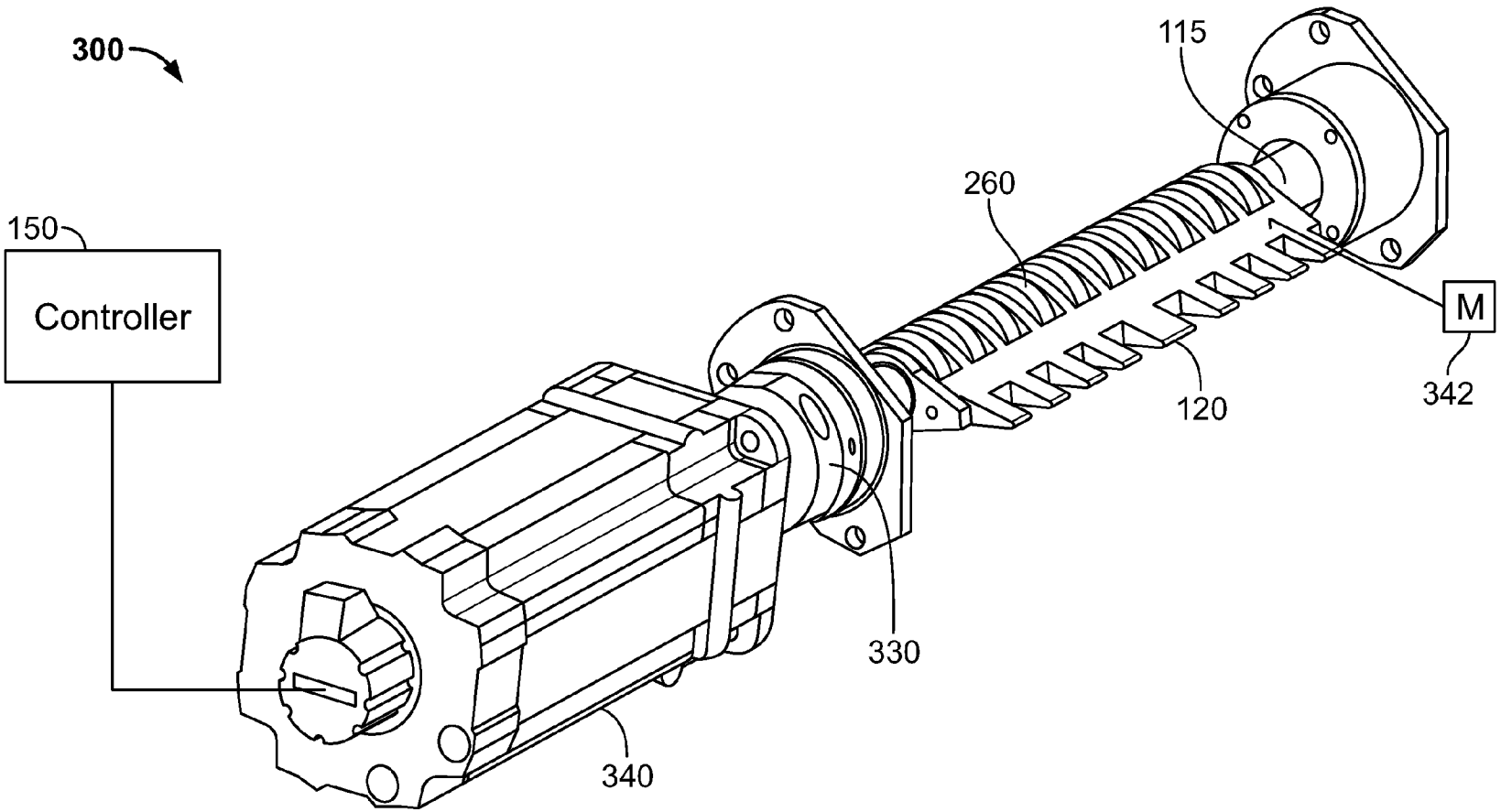

In a further embodiment shown in FIGS. 8, 9A and 9B, diverter 300 includes a low inertia roll 260 coupled to a servo motor 340 to divert a single stream of products 210 to multiple output streams. In this embodiment, controller 150 may force the roll 260 to rotate in the appropriate direction and at the same surface speed of the product 210 entering the diverter 300. Once the product exits diverter 300, controller 150 changes the direction of rotation of the motor 340 and correspondingly of roll 260, and adjusts the speed to match the surface speed of the next product 210 entering diverter 300.

The low inertia roll 260 may also be integrated with a flipper type diverter so that the flipper 120 mounted on a shaft 115 having an axis coincident with the axis of roll 260, under the control of controller 150 via a separate motor 342, helps steer the lead edge of the product 210 towards the low inertia roll 260 where it will be positively driven into the desired output product stream. In particular, as shown in FIG. 9A, when flipper 120 is moved downward in a direction 280, incoming product is directed over roll 260 in a direction 270. As shown in FIG. 9B, when flipper 120 is moved upward in a direction 285, incoming product 210 is directed under roll 260 in a direction 290.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. An apparatus for diverting incoming printed products comprising:

a roll having an axis;

a first motor coupled to the roll; and a controller coupled to the first motor for controlling the rotation of the roll for diverting printed products along one of two different paths, each path associated with a direction of rotation of the roll;

the controller programmed to control the rotation of the roll with a preset cam table.

2. The apparatus of claim 1, further comprising:

a shaft having an axis coincident with the axis of the roll;

at least one flipper mounted in a fixed direction on the shaft;

a second motor coupled to the shaft;

the controller being also coupled to the second motor for controlling positioning of the at least one flipper mounted on the shaft to assist in diverting the printed product along one the two different paths.

3. The apparatus of claim 1, wherein the first motor is a servo motor.

4. The apparatus of claim 1, further comprising a coupler interconnected between the first motor and the roll.

5. The apparatus of claim 4, wherein the coupler is a low inertia coupler.

6. The apparatus of claim 1 wherein the controller is configured to control the rotation of the roll.

7. The apparatus of claim 6 wherein the controller is configured according to a predetermined electronic cam profile.

* * * * *